US008241064B2

(12) United States Patent
Ohtsuji et al.

(10) Patent No.: US 8,241,064 B2
(45) Date of Patent: Aug. 14, 2012

(54) CONNECTOR HAVING A BODY WITH AN REINFORCEMENT MEMBER FITTING INTO AN INWARDLY BENT PORTION OF A SHIELD CASE

(75) Inventors: Takahisa Ohtsuji, Yao (JP); Takayuki Nagata, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 13/043,863

(22) Filed: Mar. 9, 2011

(65) Prior Publication Data

US 2011/0237127 A1 Sep. 29, 2011

(30) Foreign Application Priority Data

Mar. 26, 2010 (JP) ..... 2010-072566
May 20, 2010 (JP) ..... 2010-116038
May 21, 2010 (JP) ..... 2010-117367

(51) Int. Cl.
*H01R 13/648* (2006.01)
*H01R 4/50* (2006.01)
*H01R 13/64* (2006.01)

(52) U.S. Cl. ..... 439/607.01; 439/345; 439/680

(58) Field of Classification Search ..... 439/607.01, 439/607.23, 607.4, 79, 541.5
See application file for complete search history.

(56) References Cited

U.S. PATENT DOCUMENTS

| | | | | |
|---|---|---|---|---|
| 5,035,652 | A * | 7/1991 | Shibano | 439/607.47 |
| 5,772,453 | A | 6/1998 | Tan et al. | |
| 6,315,610 | B1 * | 11/2001 | Zheng et al. | 439/607.11 |
| 6,939,177 | B2 * | 9/2005 | Kato et al. | 439/607.01 |
| 7,927,142 | B2 * | 4/2011 | Wang et al. | 439/607.04 |
| 2005/0048839 | A1 | 3/2005 | Zhang | |
| 2005/0118876 | A1 | 6/2005 | Niitsu | |
| 2007/0149032 | A1 | 6/2007 | Saito et al. | |
| 2009/0142946 | A1 | 6/2009 | Lu | |
| 2009/0149045 | A1 | 6/2009 | Chen et al. | |
| 2010/0062653 | A1 | 3/2010 | Mao et al. | |
| 2010/0227504 | A1 * | 9/2010 | Wang et al. | 439/607.41 |

FOREIGN PATENT DOCUMENTS

| | | | |
|---|---|---|---|
| CN | 201397899 | Y | 2/2010 |
| EP | 1 274 155 | A1 | 1/2003 |
| EP | 2 120 299 | A2 | 11/2009 |
| JP | 2004-537836 | A1 | 12/2004 |
| JP | 2009-4302 | A1 | 1/2009 |
| JP | 2009-277497 | A1 | 11/2009 |
| WO | WO 03/012928 | A1 | 2/2003 |
| WO | WO 03/028169 | A1 | 4/2003 |
| WO | WO 2009/115922 | A2 | 9/2009 |

OTHER PUBLICATIONS

Extended European Search Report issued on Aug. 1, 2011 for counterpart European patent application No. 11250385.9.

* cited by examiner

*Primary Examiner* — Chandrika Prasad
(74) *Attorney, Agent, or Firm* — Kratz, Quintos & Hanson, LLP

(57) ABSTRACT

The invention provide a connector including a body having an insulating property, a contact provided in the body, a tuboid shield case adapted to receive the body, and a reinforcing member. The shield case includes a bent portion being a portion of the shield case bent inward and extending in an insertion direction of the body, and a depression being provided on a backside of the bent portion and extending in the insertion direction. The reinforcing member is configured to fit in at least a part of the depression.

9 Claims, 16 Drawing Sheets

CONNECTOR HAVING A BODY WITH AN REINFORCEMENT MEMBER FITTING INTO AN INWARDLY BENT PORTION OF A SHIELD CASE

The present application claims priority under 35 U.S.C. §119 of Japanese Patent Application Nos. 2010-072566 filed on Mar. 26, 2010, 2010-116038 filed on May 20, 2010, and 2010-117367 filed on May 21, 2010, the disclosures of which are expressly incorporated by reference herein in their entity.

BACKGROUND OF THE INVENTION

1. Technical Field

The present invention relates to a connector having a shield case and to electronic equipment having the same connector.

2. Background Art

A conventional connector of this type includes a rectangular tuboid shield case, a body received in the shield case, and contacts provided in the body, wherein the shield case has a top plate and a bottom plate opposed to the top plate, and the bottom plate is provided at its center with a bent portion that is bent toward the top plate into a generally U shape. The bent portion extends from an end to the opposite end along a body insertion direction so as to partition an internal space of the shield case into first and second slots each for fittingly receiving a mating connector (see Patent Literature 1).

CITATION LIST

Patent Literature 1: Japanese Unexamined Patent Publication No. 2009-277497

SUMMARY OF INVENTION

The shield case with the bent portion has a problem that the bent portion is vulnerable to prying force applied by a mating connector fitted in the first or the second slot and twisted in a circumferential direction. The prying force may cause deformation of the bent portion and its surrounding area.

The present invention has been devised in view of the above-described situation. The invention provides a connector having a bent portion that is less likely to deform if prying force is applied to the connector. The invention also provides electronic equipment having the same connector.

In view of the above-described problem, a connector of the present invention includes a body having an insulating property, a contact provided in the body, a tuboid shield case adapted to receive the body, and a reinforcing member. The shield case includes a bent portion being a portion of the shield case bent inward and extending in an insertion direction of the body, and a depression being provided on a backside of the bent portion and extending in the insertion direction. The reinforcing member is configured to fit in at least a part of the depression.

In the above-described connector, as the reinforcing member is configured to fit in at least a part of the depression on the back side of the bent portion, the bent portion and its surrounding area are less likely to deform if prying force is applied to the shield case by a mating connector inserted into the shied case. The invention makes it possible to improve the connector in prying resistance.

The reinforcing member may fit in the whole of the depression. The reinforcing member fit in the entire depression is further advantageous in minimizing deformation of the bent portion and its surrounding area, improving the prying resistance of the connector.

If the body includes a first surface in the insertion direction and a second surface on an opposite side of the first surface in the insertion direction, the reinforcing member may preferably project from the first surface of the body. The reinforcing member projectingly and integrally provided on the body is advantageous in reducing the number of components. Moreover, as the reinforcing member is provided on the first surface in the insertion direction of the body, it can be inserted into the depression when inserting the body into the shield case. Such configurations serve to reduce assembling manhours of the connector.

The bent portion may partition an internal space of the shield case into first and second slots. Alternatively, the bent portion may function as a key portion that is insertable into a key groove of a mating connector.

The shield case may be an electrically conductive plate bent into a tuboid shape, and the shield case may further include a joining portion formed by joining end portions of the plate. In this case, the reinforcing member fitted in at least a part of the depression on the back side of the bent portion can prevent deformation of the bent portion and its surrounding area, thereby preventing the joining portion from getting disjoined and released open.

Electronic equipment of the present invention may include the above-described connector as an external interface.

BRIEF DESCRIPTION OF DRAWINGS

FIG. 1A illustrates the connector as seen from the front, plan and right side, and FIG. 1B illustrates the connector as seen from the back, plan and right side.

FIG. 2A is a front view, FIG. 2B is a back view, FIG. 2C is a plan view, FIG. 2D is a bottom view, FIG. 2E is a right side view, and FIG. 2F is a left side view.

FIG. 7A illustrates an integrated plug connector, FIG. 7B illustrates a single plug connector to be connected to a first slot of the connector, and FIG. 7C illustrates a single plug connector to be connected to a second slot of the connector.

FIG. 8A is a perspective view of the connector as seen from the front, plan and right side, and FIG. 8B is a perspective view of the connector as seen from the back, plan and right side.

FIG. 9A is a front view, FIG. 9B is a back view, FIG. 9C is a plan view, FIG. 9D is a bottom view, FIG. 9E is a right side view, and FIG. 9F is a left side view.

FIG. 100 is a cross-sectional view of the connector taken along 10C-10C in FIG. 9A.

DESCRIPTION OF EMBODIMENTS

Figure 1A:
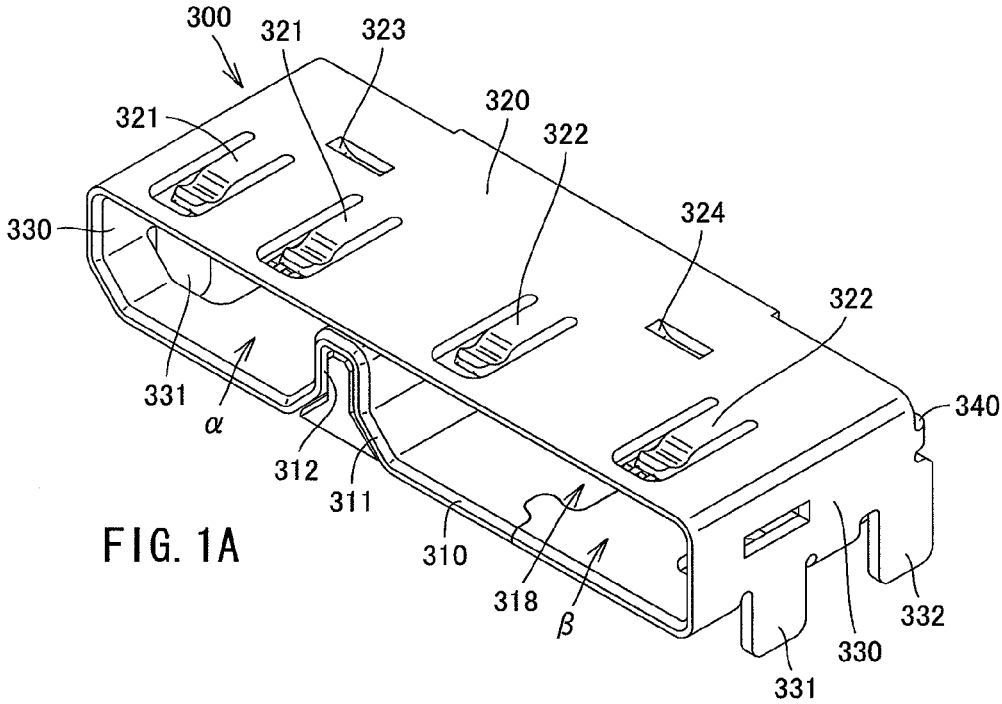
FIGS. 1A and 1B are schematic perspective views of a connector according to a first embodiment of the present invention.

First and second embodiments of the present invention will be described below.

First Embodiment

First, a receptacle connector according to a first embodiment of the present invention will be described with reference to FIGS. 1A to 7C. The receptacle connector shown in FIGS. 1A to 3D is a connector adapted to be mounted on a circuit board 10 of electronic equipment such as a television receiver and used as an external interface of the electronic equipment. The receptacle connector includes first and second bodies 100*a*, 100*b*, a plurality of first, second, third, fourth contacts 200*a*, 200*b*, 200*c*, 200*d*, and a shield case 300. These respective elements will be described in detail below. It should be noted that the direction to insert the first and second bodies 100*a*, 100*b* into an accommodating space (to be described) is indicated as an insertion direction γ in FIGS. 4 and 5.

The shield case 300 is fabricated by press-molding a electrically conductive metal plate into a generally rectangular tuboid shape, as shown in FIGS. 1A to 5. The shield case 300 has a bottom plate 310, a top plate 320, a pair of side plates 330, and a pair of lock pieces 340. The bottom plate 310 is a generally rectangular plate opposed to the top plate 320, and an outer surface of the bottom plate 310 is adapted to be placed on the circuit board 10. The side plates 330 are provided upright at widthwise ends of the bottom plate 310. Upper ends of the side plates 330 are coupled by the top plate 320. The depth (length in the insertion direction γ) of the bottom plate 310 is shorter than each depth of the top plate 320 and the side plates 330, as shown in FIGS. 3A to 3D. The bottom plate 310, and a front portion of the top plate 320, and front portions of the side plates 330 define an internal space of the shield case 300, and rear portions of the top plate 320 and the side plates 330 define the accommodating space for accommodating the first and second bodies 100*a*, 100*b* inserted from a rear side.

Figure 2A:
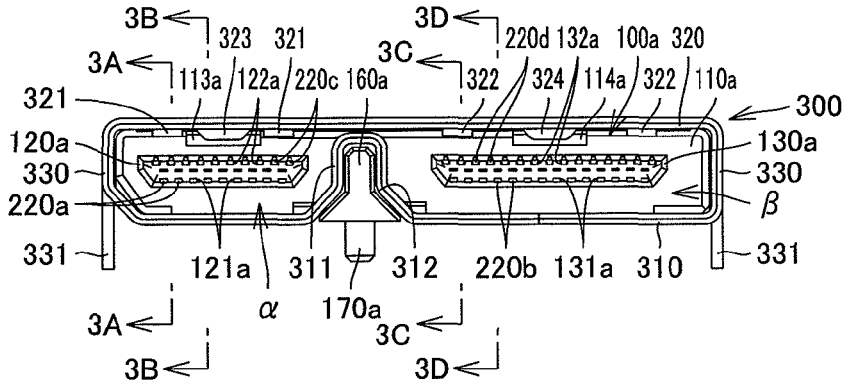
FIGS. 2A to 2F are schematic views of the connector, where
Figure 2B:
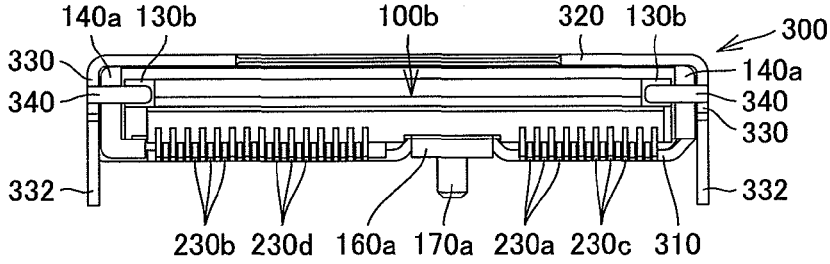
Figure 2C:
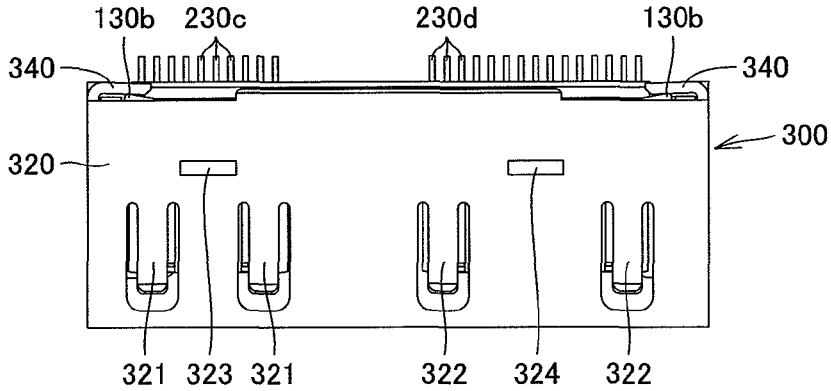
Figure 2D:
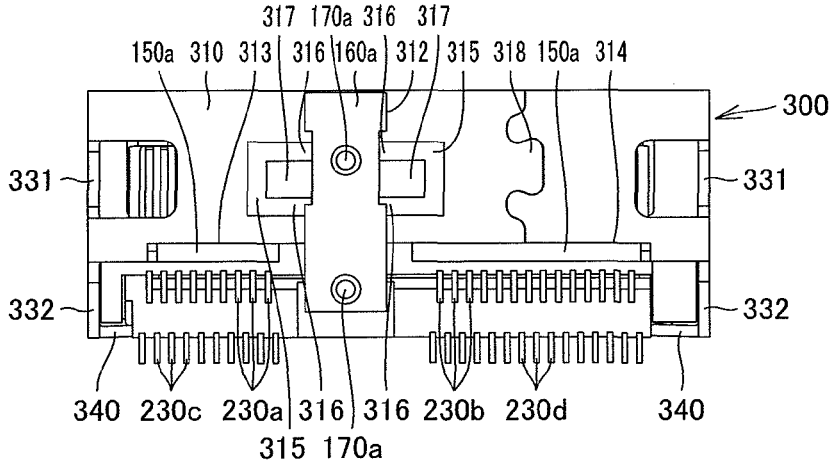
Figure 2E:
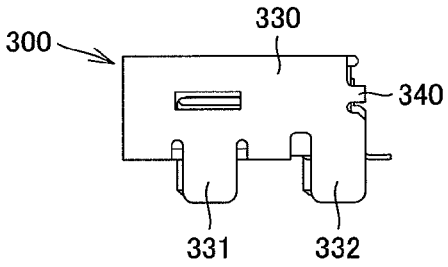
Figure 2F:
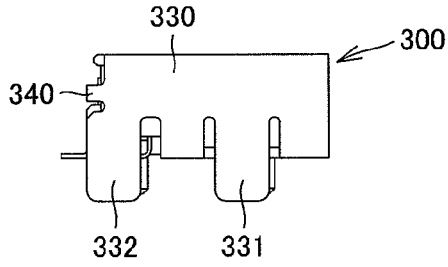
Figure 5:
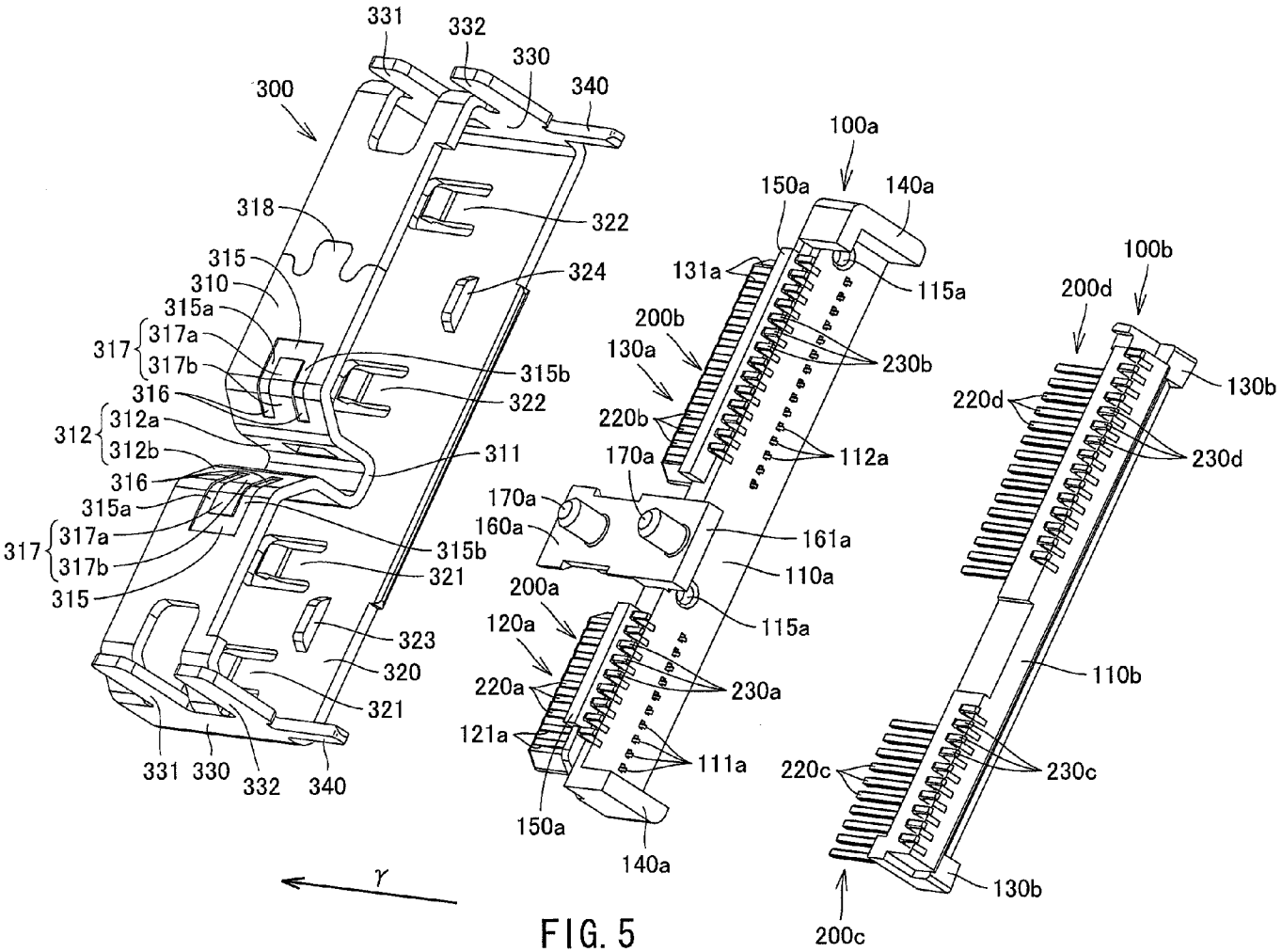
FIG. 5 is an exploded perspective view of the connector as seen from the back, bottom and left side.
Figure 6:
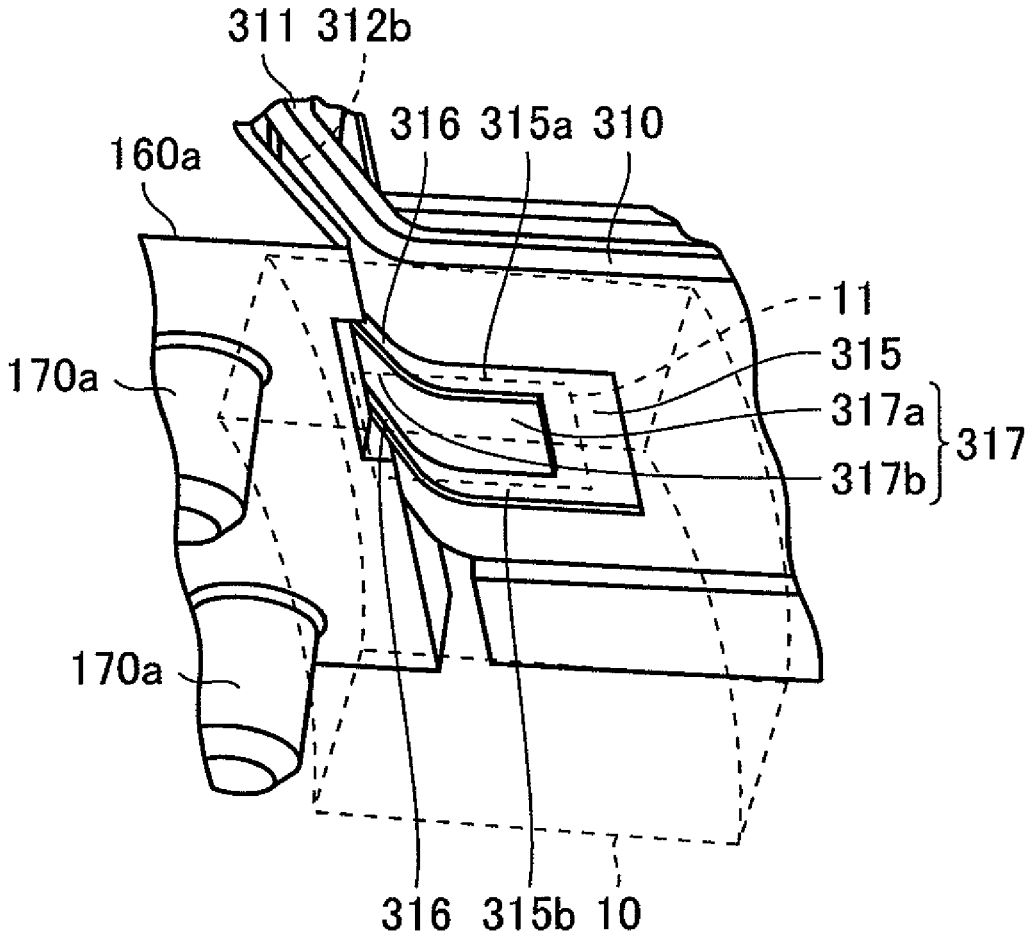
FIG. 6 is an explanatory view showing a state where pads of a shield case of the connector are connected to electrodes of a circuit board by soldering.

As shown in FIGS. 1A and 2A, the bottom plate 310 is bent at its central portion into a generally inverted U shape extending toward the top plate 320. The bent central portion (corresponding to "bent portion" recited in the claims) serves as a partition 311 to partition the internal space of the shield case 300 into first and second slots α, β. The back side of the partition 311 forms a depression 312 having a generally inverted U-shaped cross section. The partition 311 and the depression 312 extend the entire depth of the bottom plate 310, i.e. from the front end to the rear end in the insertion direction γof the bottom plate 310, as shown in FIG. 5. The depression 312 consists of a rectangular upper depression 312*a* and a lower depression 312*b*. The distance between the opposite walls of the lower depression 312*b* are gradually increased toward the lower end, such that the inner surfaces of the lower depression 312*b* are inclined with respect to the outer surface of the bottom plate 310. In the boundary areas of the outer surface of the bottom plate 310 with the inner surfaces of the lower depression 312*b*, there are formed generally U-shaped first recesses 315, each of which has first and second end portions 315*a*, 315*b*, as shown in FIGS. 5 and 6. In each of the first recesses 315, the opening between the first and second end portions 315*a*, 315*b* faces inward, i.e. toward the depression 312. In each of boundary areas of the inner surfaces of the lower depression 312*b* with the outer surface of the bottom plate 310, there is formed a pair of rectangular second recesses 316, communicating with the first and second end portions 315*a*, 315*b* of the first recess 315. Areas defined by the first and second recesses 315, 316 serve as pads 317 for connection by soldering with a pair of ground electrodes 11 of the circuit board 10. The pads 317 each have first and second pad portions 317*a*, 317*b*. The first pad portions 317*a* are provided in the outer surface of the bottom plate 310. The surfaces of the first pad portions 317*a* are located at the same height as (i.e. flush with) the outer surface of the bottom plate 310. The second pad portions 317*b* are provided in the inner surfaces of the lower depression 312*b* and inclined with respect to the first pad portions 317*a*. The surfaces of the second pad portions 317*b* are located at the same height as (i.e. flush with) the inner surfaces of the lower depression 312*b*. The ground electrodes 11 are generally rectangular surface electrodes, each having a contactable portion contactable to the first pad portion 317*a* and an extended portion extended from the contactable portion toward the second pad portion 317*b* side.

Figure 3A:
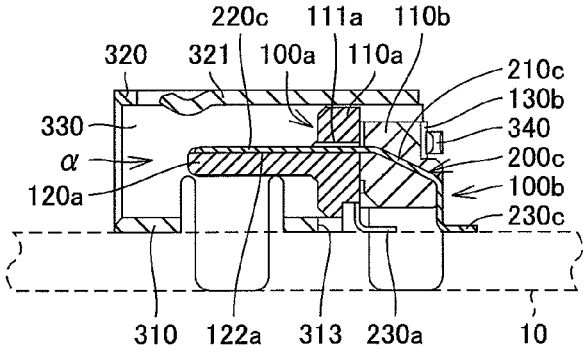
FIG. 3A is a cross-sectional view of the connector taken along 3A-3A in FIG. 2A.
Figure 3B:
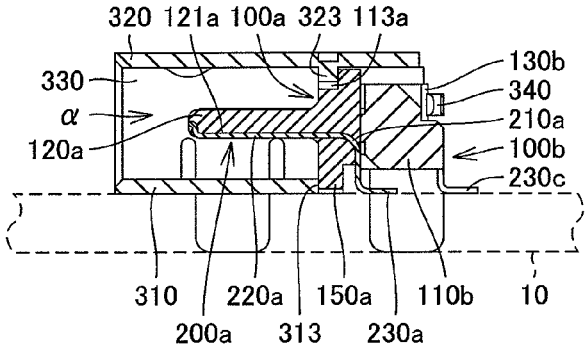
FIG. 3B is a cross-sectional view of the connector taken along 3B-3B in FIG. 2A.
Figure 3C:
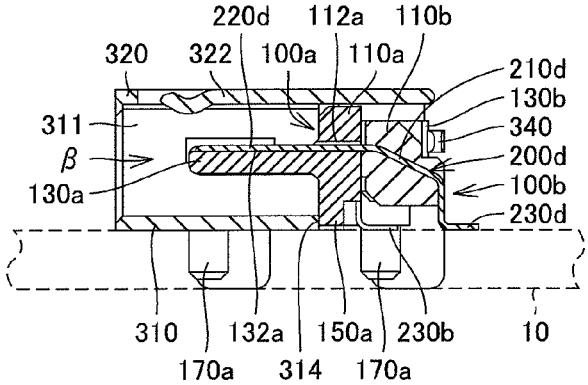
FIG. 3C is a cross-sectional view of the connector taken along 3C-3C in FIG. 2A.
Figure 3D:
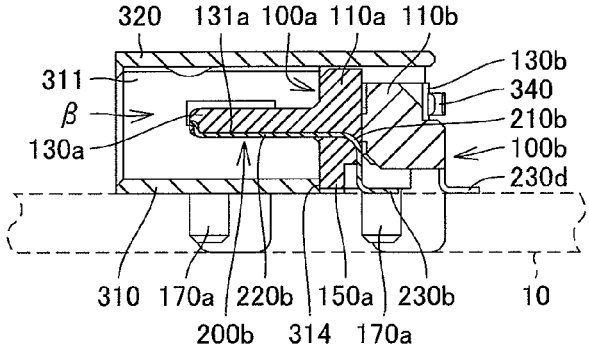
FIG. 3D is a cross-sectional view of the connector taken along 3D-3D in FIG. 2A.
Figure 7A:
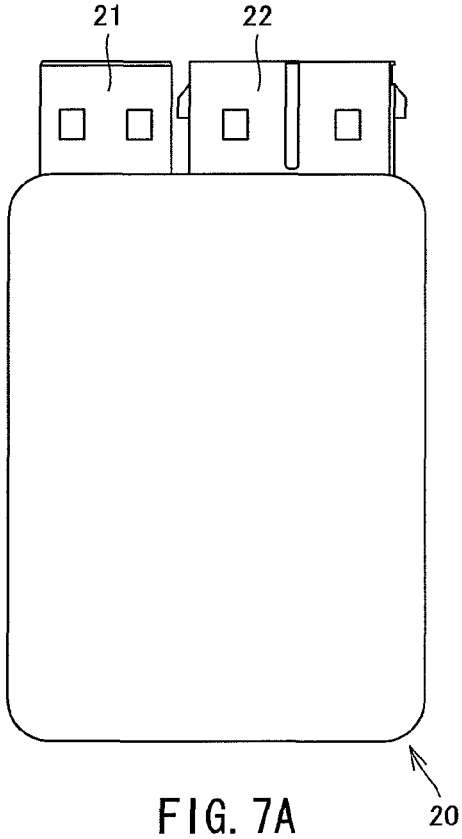
FIGS. 7A to 7C are plan views each showing a plug connector to be connected to the above connector.
Figure 7B:
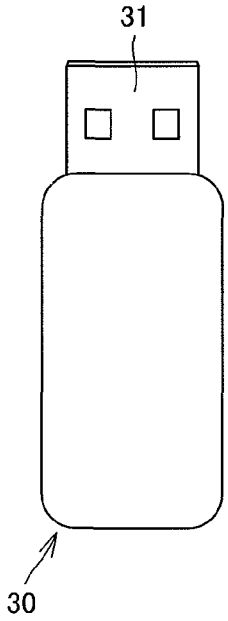
Figure 7C:
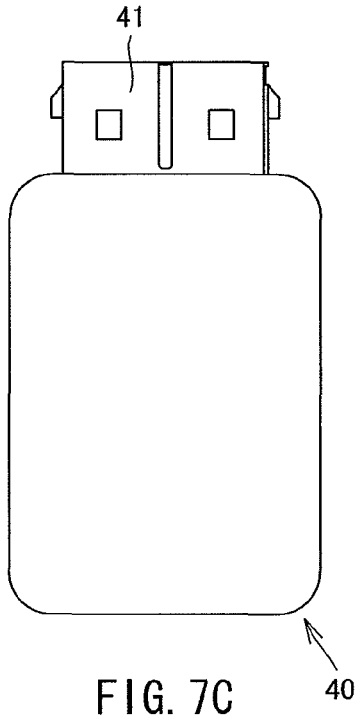
Figure 8A:
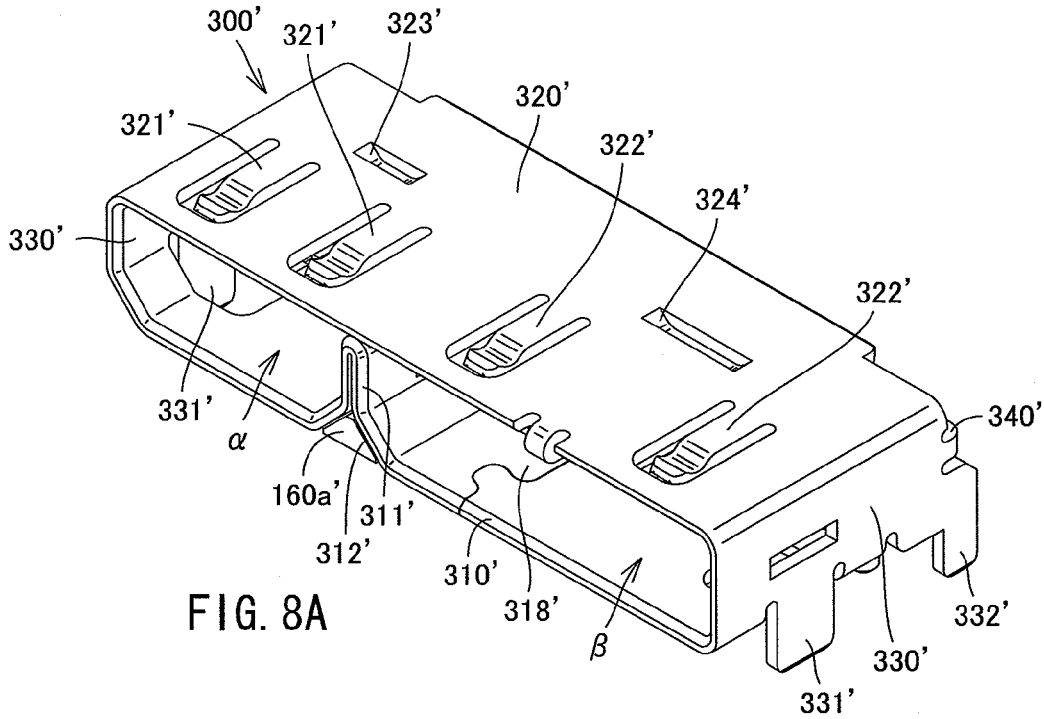
FIGS. 8A and 8B are schematic perspective views of a connector according to a second embodiment of the present invention.
Figure 8B:
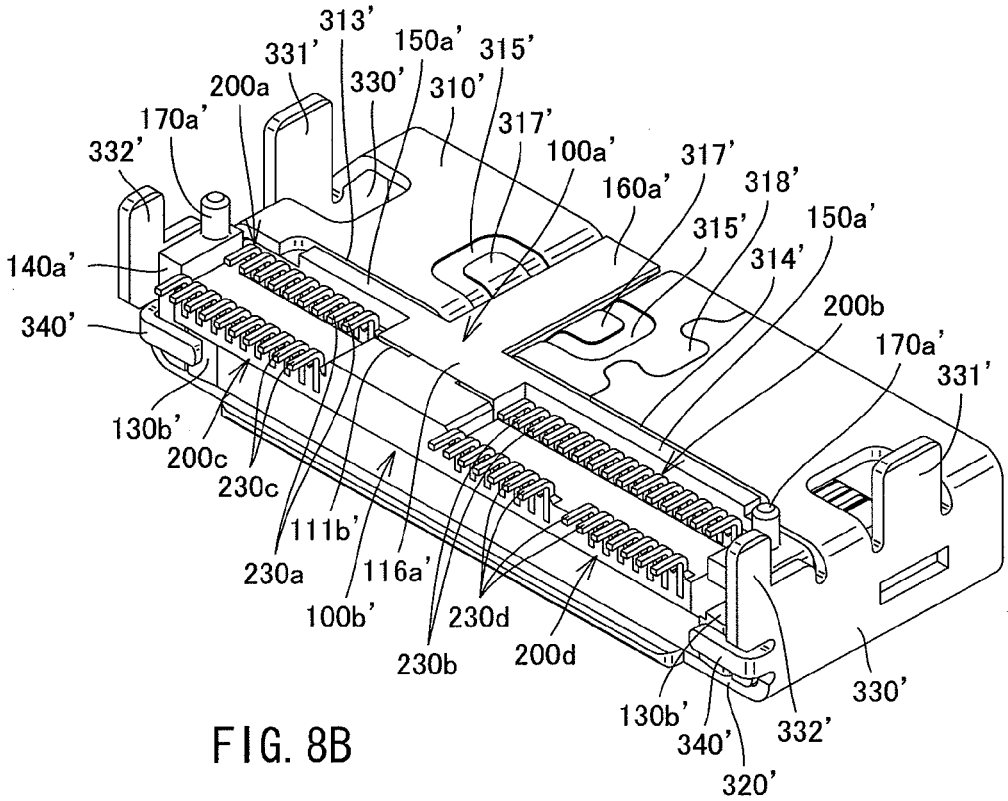
Figure 9A:
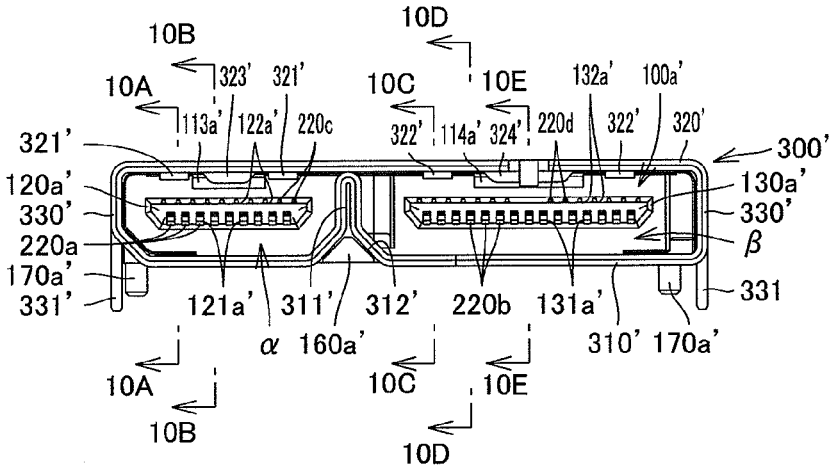
FIGS. 9A to 9F are schematic views of the connector, where
Figure 9B:
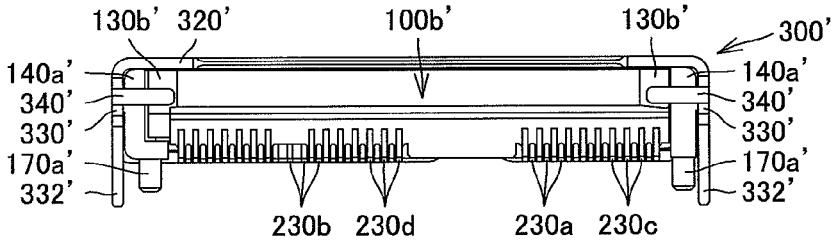
Figure 9C:
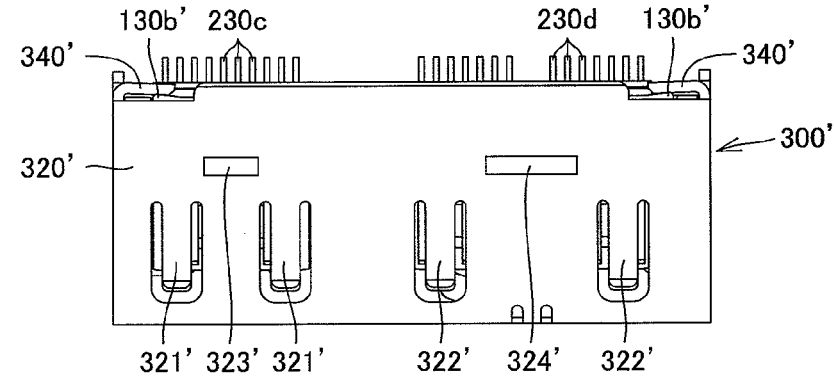
Figure 9D:
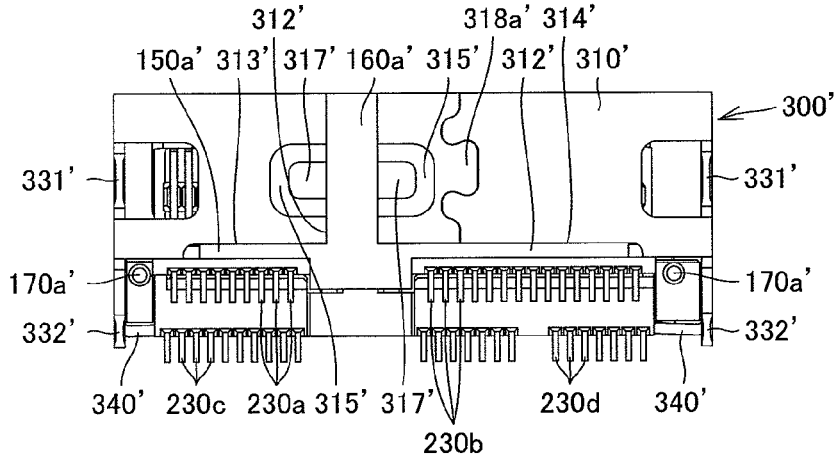
Figure 9E:
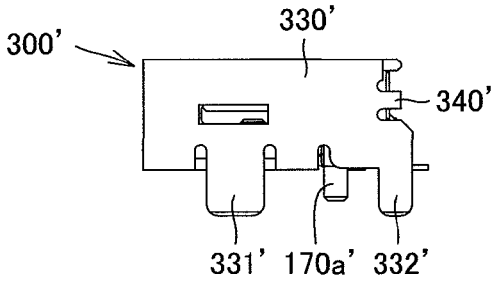
Figure 9F:
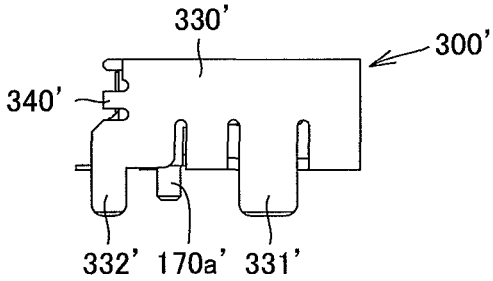
Figure 10A:
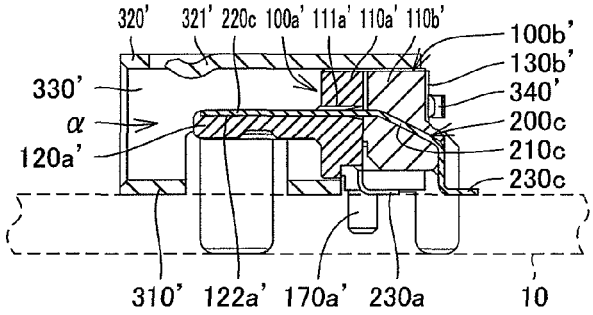
FIG. 10A is a cross-sectional view of the connector taken along 10A-10A in FIG. 9A.
Figure 10B:
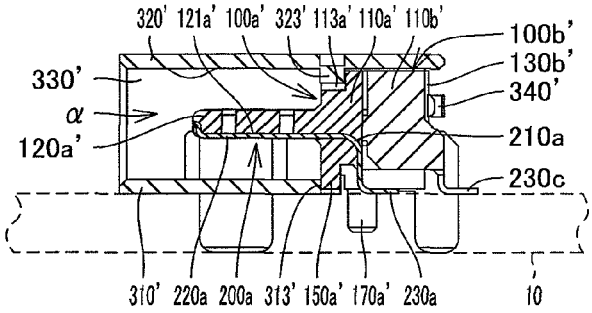
FIG. 10B is a cross-sectional view of the connector taken along 10B-10B in FIG. 9A.
Figure 10C:
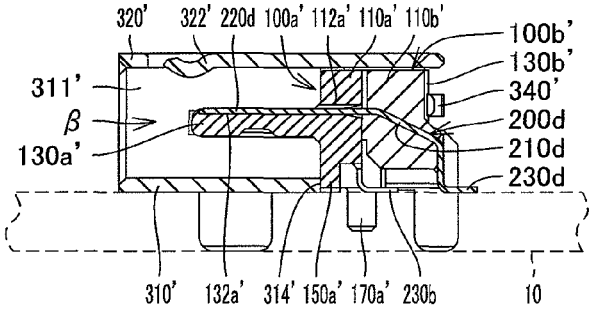
FIG. 10D is a cross-sectional view of the connector taken along 10D-10D in FIG. 9A.
FIG. 10E is a cross-sectional view of the connector taken along 10E-10E in FIG. 9A.
Figure 10D:
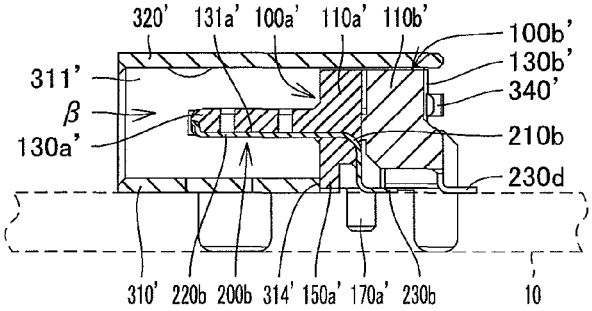
Figure 10E:
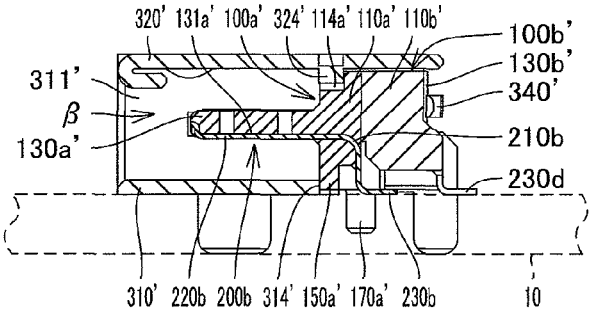

The bottom plate 310 has a joining portion 318 on the second slot β side. The joining portion 318 is a portion where end portions of a metal plate forming the shield case 300 are joined and swaged. Providing the joining portion of the shield case 300 on the second slot β side portion of the bottom plate 310 makes it possible to secure favorable strength of the first and second slot α, β portions of the shield case 300. The first slot α has an inner shape conforming to an outer shape of a connection portion 21 for HDMI (High-Definition Multimedia Interface, registered trademark) Type D of a plug connector 20, as shown in FIG. 7A, or a connection portion 31 for the HDMI Type D of a plug connector 30 as shown in FIG. 7B. The second slot β has an inner shape conforming to an outer shape of a connection portion 22 of another standard than HDMI of the plug connector 20, as shown in FIG. 7A, or a connection portion 41 of another standard than HDMI of a plug connector 40 as shown in FIG. 7C. That is, the first slot α is adapted to receive the connection part 21 or the connection part 31, and the second slot β is adapted to receive the connection part 22 or the connection part 41. Moreover, rear surfaces of the bottom plate 310, corresponding to first and second slot α and β, serve as abutting-stop surfaces 313, 314 to abut front surfaces of a pair of elongated protrusions 150*a* (to be described) of the first body 100*a*, as shown in FIGS. 3B to 3D.

Figure 1B:
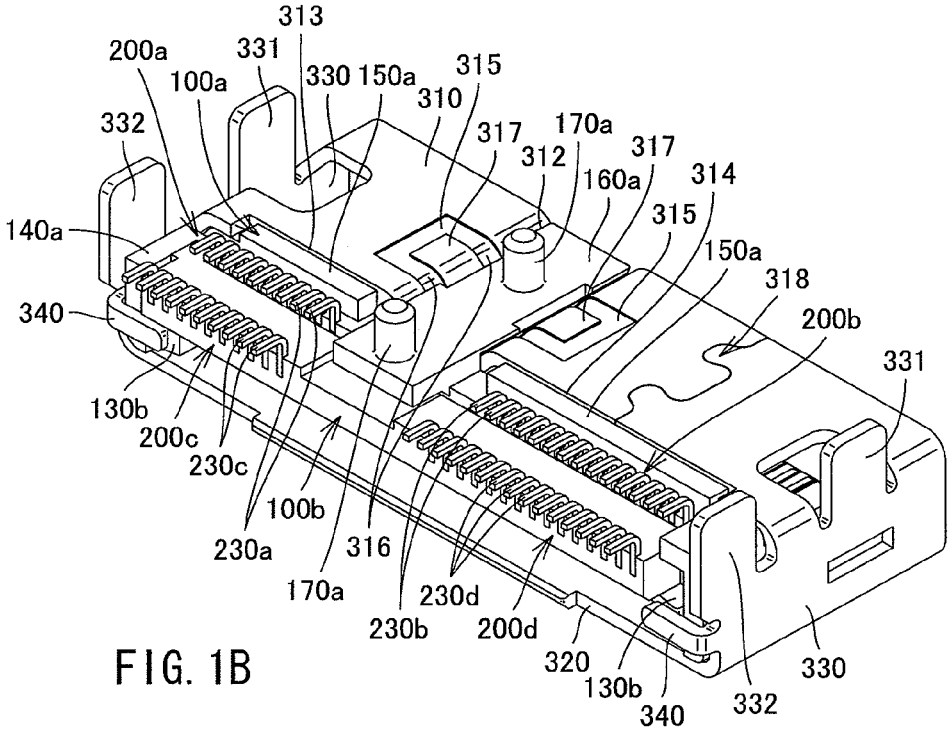

The top plate 320 is a generally rectangular plate portion as shown in FIGS. 1A and 1B. The top plate 320 are cut at portions to form two locking pieces 321 and two locking pieces 322. Distal ends of the locking pieces 321, 322 are bent downward into circular arcs. When inserting a plug connector 20 or 30 into the first slot α, its connection part 21 or 31 is elastically contacted and held by the distal ends of the locking pieces 321. Similarly, when inserting a plug connector 20 or 40 into the second slot β, its connection part 21 or 41 is elastically contacted and held by the distal ends of the locking pieces 322. Moreover, the top plate 320 are partially cut at portions posterior to the locking pieces 321, 322 and depressed downward to form abutting-stops 323, 324.

A lower end of each of the side plates 330 is provided with a front terminal 331 and a rear terminal 332 extended downward. The front terminals 331 are formed by partly cutting opposite widthwise end portions of the bottom plate 310 and bending these cut parts downward. The rear terminals 332 are formed by cutting and bending downward portions of the cut-away area of the bottom plate 310, which portions are reserved before cutting away the cut-away area to make the depth dimension of the bottom plate 310 smaller than the top plate 320 and the side plates 330. The front terminals 331 and the rear terminals 332 are to be inserted into through-hole electrodes (not shown) of the circuit board 10. The lock pieces 340 are extended from rear ends of the side plates 330.

The first body 100*a* is an injection-molded article of insulating resin. The first body 100*a* has a main body 110*a*, first and second projected portions 120*a*, 130*a*, a pair of guides 140*a*, the pair of elongated protrusions 150*a*, a reinforcing member 160*a*, and a pair of locking projections 170*a*, as shown in FIGS. 3A to 5. The main body 110*a* is a plate having a rectangular cross-section. The main body 110*a* has a plurality of first and second holes 111*a*, 112*a* formed in the insertion direction γ through the main body 110*a* and arranged at spaced intervals in a row along the width of the first body 100*a*. As shown in FIGS. 3A to 3D and FIG. 4, cutaways 113*a*, 114*a* are provided in an upper end portion of a front surface in the insertion direction γ of the main body 110*a*. The cutaways 113*a*, 114*a* are adapted to receive the abutting-stops 323, 324 of the shield case 300, so that the abutting-stops 323, 324 abut back surfaces of the cutaways 113*a*, 114*a* from the front side.

The front surface in the insertion direction γ of the main body 110*a* (first surface of the body) is provided with the plate-like first and second projected portions 120*a*, 130*a* to be inserted into the first and second slots α, β. The first and second projected portions 120*a*, 130*a* have such outer shapes as to fit in connection holes (not shown) of the connection parts 21, 22 of the plug connector 20 shown in FIG. 7A. The lower surfaces of the first, second projected portions 120*a*, 130*a* has a plurality of first and second long grooves 121*a*, 131*a* at spaced intervals in a row in the width direction. The upper surfaces of the first and second projected portions 120*a*, 130*a* has a plurality of third and fourth long grooves 122*a*, 132*a* at spaced intervals in a row in the width direction, in communication with the first and second holes 111*a*, 112*a*, respectively. The first, second, third and fourth long grooves 121*a*, 131*a*, 122*a*, 132*a* extend in the insertion direction γ. Each of the third long grooves 122*a* is located in plan position between adjacent first long grooves 121*a*. Each of the fourth long grooves 132*a* is located in plan position between adjacent second long grooves 131*a*. In other words, as shown in FIG. 2A, the first long grooves 121*a* and the third long grooves 122*a* are arranged in a zigzag manner, and the second long grooves 131*a* and the fourth long grooves 132*a* are arranged in a zigzag manner.

Figure 4:
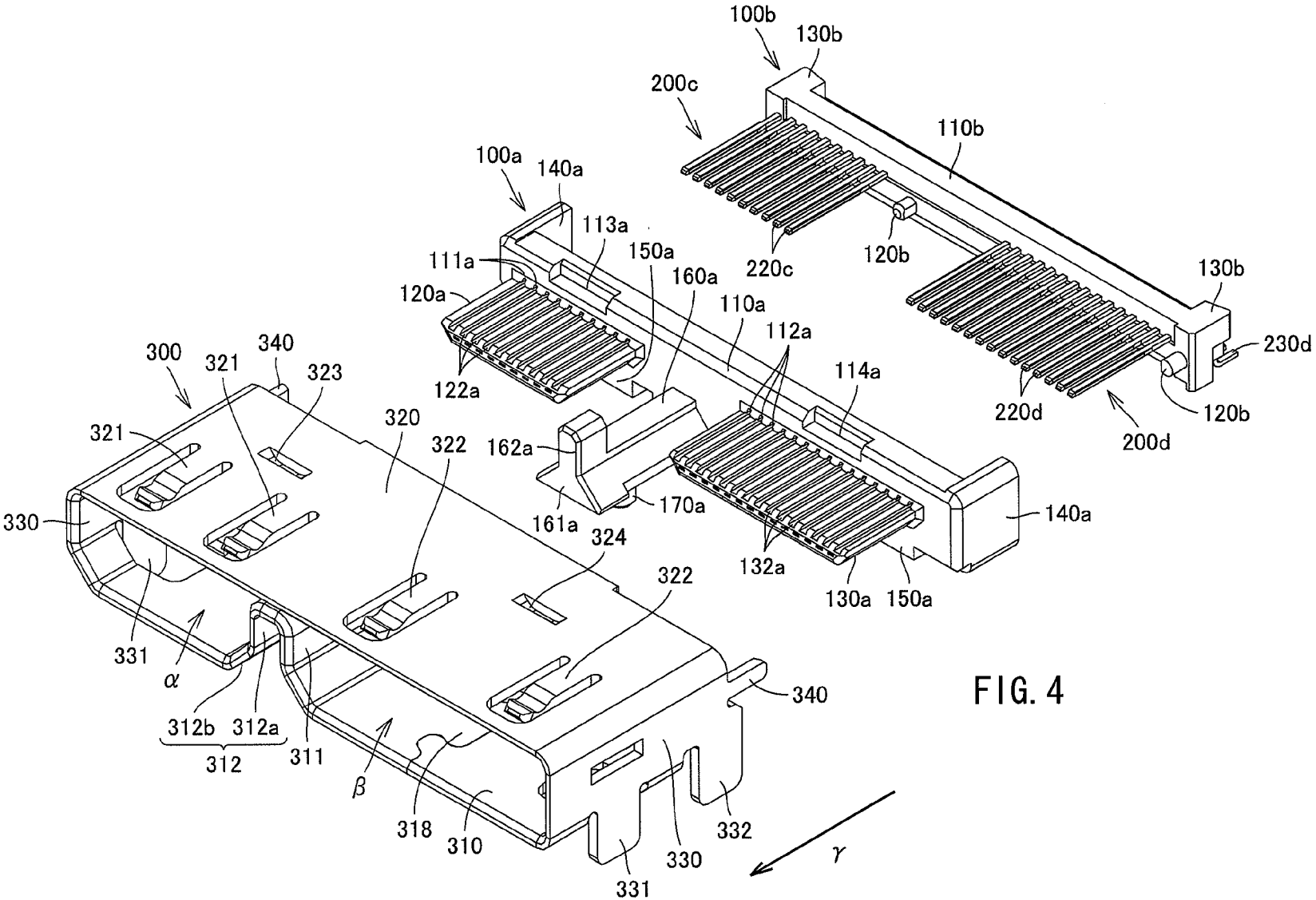
FIG. 4 is an exploded perspective view of the connector as seen from the front, plan and right side.

The reinforcing member 160*a* of generally L-shape is provided centrally at a lower end of the front surface of the main body 110*a*, as shown in FIG. 4. The reinforcing member 160*a* has an arm 161*a* of generally triangular prism shape and a projection 162*a* of rectangular prism shape. The arm 161*a* is a generally triangular prism extending forward from the front of the main body 110*a*. The projection 162*a* is a rectangular prism projecting upward from the distal end of the arm 161*a*. The projection 162*a* fits in the upper depression 312*a* of the depression 312 of the shield case 300, and the arm 161*a* fits in the lower depression 312*b* of the depression 312. The reinforcing member 160*a* thus fits in a part of the depression 312 of the shield case 300. The pair of columnar locking projections 170*a* is provided on the lower surface of the arm 161*a*. The locking projections 170*a* are to be inserted into locking holes (not shown) of the circuit board 10.

As shown in FIG. 5, in the main body 110*a*, the plurality of first and second contacts 200*a*, 200*b* are arrayed at spaced intervals in a row in the width direction. Each of the first contacts 200*a* is a conductive elongated metal plate as shown in FIG. 3B and has an embedded portion 210*a*, a contact portion 220*a* and a tail portion 230*a*. The embedded portion 210*a* is a generally inverted L-shaped and embedded in the main body 110*a*, and a rear end portion thereof projects downward from the main body 110*a*. The contact portion 220*a* extends straight continuously from a distal end of the embedded portion 210*a* and is received in one of the first long grooves 121*a* of the first projected portion 120*a*. The tail portion 230*a* is a flat plate continuing to a rear end of the embedded portion 210*a* and bent at a right angle with respect to the rear end portion of the embedded portion 210*a*. Each of the second contacts 200*b* is a conductive elongated metal plate as shown in FIG. 3D and has an embedded portion 210*b*, a contact portion 220*b*, and a tail portion 230*b*. The second contacts 200*b* have the same configuration as the first contacts 200*a*, except that the contact portions 220*b* are to be received in the second long grooves 131*a* of the second projected portion 130*a*. As such, the respective portions of the second contacts 200*b* will not be further described with regard to overlap with the first contacts 200*a*.

The pair of elongated protrusions 150*a* is provided on the lower surface of main body 110*a*. The elongated protrusions 150*a* are adapted to abut the abutting-stop surfaces 313, 314 of the bottom plate 310 of the shield case 300 from the front side. The pair of guides 140*a* is provided at the widthwise ends of a rear surface in the insertion direction γ of the main body 110*a*. The top surfaces of the guides 140*a* are adapted to abut the top plate 320 of the shield case 300, improving the degree of parallelism of the combined first and second bodies 100*a* and 100*b* in relation to the top plate 320 of the shield case 300. As shown in FIG. 5, the rear surface of the main body 110*a* has fitting holes 115*a*, one between the first and second holes 111*a* and 112*a* and the other outside the second holes 112*a*.

The second body 100*b* is an injection-molded article of insulating resin, as shown in FIGS. 3A to 5. The second body 100*b* has a main body 110*b*, a pair of fitting projections 120*b*, and a pair of hills 130*b*. The main body 110*b* has a generally L-shaped cross-section, and its width is a little smaller than a distance between the guides 140*a* of the first body 100*a*. When the second body 100*b* is inserted between the guides 140*a* of the first body 100*a*, the first and second bodies 100*a*, 100*b* are combined anteroposteriorly in the insertion direction γ. As shown in FIG. 4, the front surface of the main body 110*b* has the pair of fitting projections 120*b* at corresponding positions to the fitting holes 115*a*. The fitting projections 120*b* are columnar projections to fit in the fitting holes 115*a* of the first body 100*a*. The fit between the fitting projections 120*b* and the fitting holes 115*a* allows the first and second bodies 100*a*, 100*b* to be maintained in a combined state. The pair of hills 130*b* is provided at widthwise ends of a rear surface in the insertion direction γ of the main body 110*b*. The hills 130*b* have enough height for their tips to project rearward from the guides 140*a* of the first body 100*a* with the first and second bodies 100*a*, 100*b* combined. The tips of the hills 130 abut the lock pieces 340 of the shield case 300 bent into generally L shapes. As a result, the first and second bodies 100*a*, 100*b* accommodated in the accommodating space of the shield case 300 are securely sandwiched between the lock pieces 340 and front abutting portions (namely, the partition 311 and the abutting-stop surfaces 313, 314 of the bottom plate 310, and the abutting-stops 323, 324 of the top plate 320). The first and second bodies 100*a*, 100*b* are thus fixed inside the accommodating space. It is appreciated that FIGS. 4 and 5 illustrates the lock pieces 340 in a straightened state before bent.

In the main body 110*b*, as shown in FIG. 4, the plurality of third and fourth contacts 200*c*, 200*d* are arrayed in a row in the width direction and at the same spaced intervals as those of the first and second holes 111*a*, 112*a*, respectively. The third and fourth contacts 200*c*, 200*d* are located above the first and second contacts 200*a*, 200*b* (i.e., at a different height position). Each of the third contacts 200*c* is a conductive elongated metal plate as shown in FIG. 3A and has an embedded portion 210*c*, a contact portion 220*c*, and a tail portion 230*c*. The embedded portion 210*c* is embedded in the main body 110*b* and has an obliquely inclined intermediate portion, and a distal portion bent with respect to the intermediate portion, and a rear portion bent with respect to the intermediate portion and extended downward. The distal portion and the intermediate portion of the embedded portion 210*c* are embedded in the main body 110*b*. The rear end portion of the embedded portion 210*c* projects downward from the main body 110*b*. The contact portion 220*c* is a flat plate continuing to the distal end of the embedded portion 210*c* and projecting from the front surface of the main body 110*b*. The contact portion 220*c* is longer than the first contact portion 220*a* by a thickness of the main body 110*a* of the first body 100*a*. The contact portion 220*c* is to be received in one of the first holes 111*a* and one of the third long grooves 122*a* of the first body 100*a*. The tail portion 230*c* is a flat plate continuing to a rear end of the embedded portion 210*c* and bent at a right angle with respect to the rear end of the embedded portion 210*c*. Each of the fourth contacts 200*d* is a conductive elongated metal plate as shown in FIG. 3C and has an embedded portion 210*d*, a contact portion 220*d*, and a tail portion 230*d*. The fourth contacts 200*d* have the same configuration as the third contacts 200*c*, except that the contact portions 220*d* are to be received in the second holes 112*a* of the first body 100*a* and in the fourth long groove 132*a* of the second projection 130*a*. As such, the respective portions of the fourth contacts 200*d* will not be further described with regard to overlap with the third contacts 200*c*.

The contact portions 220*a* received in the first long grooves 121*a* and the contact portions 220*c* received in the third long grooves 122*a* are arranged in a zigzag manner. In other words, each of the contact portions 220*c* of the third contacts 200*c* is at a plan position between adjacent ones of contact portions 220*a* of the first contacts 200*a*. The contact portions 220*a*, 220*c* thus arranged are inserted into the first slot α together with the first projected portion 120*a*, in a contactable manner with lower and upper contacts of the connection part 21 or 31 of a plug connector 20 or 30 inserted into the first slot α. Similarly, the contact portions 220*b* received in the second long grooves 131*a* and the contact portions 220*d* received in the fourth long grooves 132*a* are arranged in a zigzag manner. In other words, each of the contact portions 220*d* of the fourth contacts 200*d* is at a plan position between adjacent ones of the contact portions 220*b* of the second contacts 200*b*. The contact portions 220*b*, 220*d* thus arranged are inserted into the second slot β together with the second projected portion 130*a*, in a contactable manner with lower and upper contacts of the connection part 22 or 41 of a plug connector 20 or 40 inserted into the second slot β. Moreover, lower surfaces of the tail portions 230*a*, 230*c* are located at the same height, and the tail portions 230*a*, 230*c* are arrayed in two anteroposterior rows in the insertion direction γ. Also, lower surfaces of the tail portions 230*b*, 230*d* are located at the same height, and the tail portions 230*b*, 230*d* are arrayed in two anteroposterior rows in the insertion direction γ. The tail portions 230*a*, 230*b*, 230*c*, 230*d* are connectable by soldering to associated surface electrodes (not shown) of the circuit board 10.

The receptacle connector having the above-described configuration may be assembled in the following steps. First, as shown in FIGS. 4 and 5, the embedded portions 210*a*, 210*b* of the first and second contacts 200*a*, 200*b* are embedded in the first body 100*a* by insert molding, and the embedded portions 210*c*, 210*d* of the third and fourth contacts 200*c*, 200*d* are embedded in the second body 100*b* by insert molding. The embedded first and second contacts 200*a*, 200*b* will be arrayed in a row in the width direction in the first body 100*a*, and the embedded third and fourth contacts 200*c*, 200*d* will be arrayed in a row in the width direction in the second body 100*b*. Simultaneously, the contact portions 220*a*, 220*b* of the first and second contacts 200*a*, 200*b* are inserted into the first and second long grooves 121*a*, 131*a*, respectively, of the first body 100*a*.

Thereafter, the first and second bodies 100*a*, 100*b* are brought relatively closer to each other, and the contact portions 220*c*, 220*d* of the third and fourth contacts 200*c*, 200*d* of the second body 100*b* are inserted into the first and second holes 111*a*, 112*a* and the third and fourth long grooves 122*a*, 132*a* of the first body 100*a*. As a result, the contact portions 220*a* and the contact portions 220*c* are arranged at the different height positions in a zigzag manner, and the contact portions 220*b* and the contact portions 220*d* are arranged at the different height positions in a zigzag manner. Simultaneously, the second body 100*b* is inserted between the pair of guides 140*a* of the first body 100*a*, using the guides 140*a* of the first body 100*a* to guide the widthwise ends of the second body 100*b*. The fitting projections 120*b* of the second body 100*b* are fitted in the fitting holes 115*a* of the first body 100*a*. Consequently, the first and second bodies 100*a*, 100*b* are combined anteroposteriorly in the insertion direction γ, so that the tail portions 230*a*, 230*c* are arranged at the same height in two anteroposterior rows in the insertion direction γ, and the tail portions 230*b*, 230*d* are arranged at the same height in two anteroposterior rows in the insertion direction γ.

Thereafter, the reinforcing member 160*a* of the first body 100*a* is inserted into the depression 312 of the shield case 300, to fit the projection 161*a* of the reinforcing member 160*a* in the upper depression 312*a* of the depression 312 and the arm 162*a* thereof in the lower depression 312*b*. During this insertion, the reinforcing member 160*a* is guided by the depression 312 along the insertion direction γ, and the first and second bodies 100*a*, 100*b* are received between the lock pieces 340 as straightened along the side plates 330. The first and second bodies 100*a*, 100*b* are inserted along the insertion direction γ, from the rear side into the accommodating space of the shield case 300, while the widthwise ends of the first body 100*a* are guided by the lock pieces 340, and the first and second projected portions 120*a*, 130*a* of the first body 100*a* are inserted into the first and second slots α, β of the shield case 300. Consequently, the front surface of the main body 110*a* of the first body 100*a* abuts the partition 311; the elongated protrusions 150*a* of the first body 100*a* abut the respective abutting-stop surfaces 313, 314 of the bottom plate 310 of the shield case 300; and the abutting-stops 323, 324 of the top plate 320 of the shield case 300 are received from the front side into the cutaways 113*a*, 114*a* of the first body 100*a* and abut the back surfaces of the cutaways 113*a*, 114*a*. The guides 140*a* of the first body 100*a* abut the top plate 320 of the shield case 300.

In this state, the lock pieces 340 are bent inward to abut the respective hills 130*b* of the second body 100*b*. Consequently, the first and second bodies 100*a*, 100*b* are securely sandwiched between the lock pieces 340 and the front abutting portions, so that the first and second bodies 100*a*, 100*b* are fixedly accommodated in the accommodating space of the shield case 300.

The receptacle connector may be thus assembled and may be mounted on the circuit board 10 in the following manner. First, the front terminals 331 and the rear terminals 332 of the shield case 300 are inserted into the through-holes of the circuit board 10. Simultaneously, the locking projections 170*a* of the first body 100*a* are inserted into and locked against the locking holes of the circuit board 10. Consequently, the outer surface of the bottom plate 310 of the shield case 300 is placed on the circuit board 10, so that the pads 317 of the shield case 300 come into contact with the pair of ground electrodes 11 of the circuit board 10, and the tail portions 230*a*, 230*b*, 230*c*, 230*d* are placed on the surface electrodes of the circuit board 10. Thereafter, the front terminals 331 and the rear terminals 332 are soldered to the through-hole electrodes of the circuit board 10, the pads 317 are soldered to the pair of ground electrodes 11, and the tail portions 230*a*, 230*b*, 230*c*, 230*d* are soldered to the surface electrodes of the circuit board 10. Solder fillets are thus formed between the second pad portions 317*b* of the pads 317 and the ground electrodes 11. The shield case 300 is electrically connected to a ground line of the circuit board 10 through the through-hole electrodes and the ground electrodes 11 of the circuit board 10, so that the shield case 300 is able to function as a shield.

In the above-described receptacle connector, the reinforcing member 160*a* is partially fitted in the depression 312 on the back side of the partition 311 of the shield case 300. If prying force is applied on the connector by the connection portion 31 of the plug connector 30 inserted into the slot a or by the connection portion 41 of the plug connector 40 inserted into the slot β, it is unlikely that the partition 311 and its surrounding area deform and that the joining portion 318 gets disjoined and released open. Therefore, the connector advantageously has improved prying resistance. Further, the reinforcing member 160*a* projects from the front surface of the main body 110*a* of the first body 100*a*, the reinforcing member 160*a* can be fitted in the depression 312 of the shield case 300 when inserting the first and second bodies 100*a*, 100*b* into the shield case 300. The above configuration can reduce assembling man-hours of the present connector.

Moreover, no clearance is produced between the outer surface of the bottom plate 310 and the circuit board 10 when the outer surface of the bottom plate 310 is placed on the circuit board 10. This is because the first recesses 315 are formed in the outer surface of the bottom plate 310 of the shield case 300, and the second recesses 316 are formed in the opposite inner surfaces of the lower depression 312*b* of the depression 312 on the back side of the partition 311; the portions defined by the first and second recesses 315, 316 function as the pads 317; and the first pad portions 317*a* of the pads 317 are coplanar with the outer surface of the bottom plate 310. Further advantageously, as the first pad portions 317*a* are surrounded by the substantially U-shaped first recesses 315, which minimizes unfavorable spread of solder into other areas of the outer surface of the bottom plate 310 facing the circuit board 10, and which minimizes intrusion of solder into the shield case 300 through the joining portion 318 of the bottom plate 310. The second pad portions 317*b* of the pads 317 are inclined with respect to the first pad portions 317*a*, allowing to form large solder fillets by applying solder to the second pad portions 317*b*. The present connector thus has an improved peel strength between its central portion and the circuit board. The present connector thus has an improved peel strength also between its end portions and the circuit board because the front terminals 331 and the rear terminals 332 of the shield case 300 are connected to the through-hole electrodes of the circuit board 10 by soldering. In summary, the present receptacle connector as a whole has such a configuration as to provide high peel strength from the circuit board.

Moreover, the nonexistence of clearance between the outer surface of the bottom plate 310 and the circuit board 10 is also favorable in reducing the mounting height of the receptacle connector. Furthermore, as the pads 317 are surrounded by the first and second recesses 315, 316, no openings are formed in the outer surface of the bottom plate 310 or in the inner surfaces of the lower depression 312*b* of the depression 312 on the back side of the partition 311, unlike a case where connection terminals are formed by cutting and downwardly bending portions of the shield case. The nonexistence of openings can thus prevent intrusion of solder and flux into the shield case 300 through the central portion or the partition 311 of the bottom plate 310 during soldering connection process. The nonexistence of openings in the central portion or the partition 311 of the bottom plate 310 is also advantageous in securing favorable prying resistance of the shield case 300.

Second Embodiment

Next, a second embodiment of the invention will be described with reference to FIGS. 7A to 12. Similarly to the receptacle connector of the first embodiment, the receptacle connector shown in FIGS. 8A to 9F is to be mounted on the circuit board 10 of electronic equipment, such as a television receiver, and used as an external interface of the electronic equipment. This receptacle connector is substantially the same as the receptacle connector of the first embodiment, except that first and second bodies 100*a*' and 100*b*' and a shield case 300' have different shapes from those of the first and second bodies 100*a*, 100*b* and of the shield case 300. Descriptions made hereinafter focus on the differences, not on overlapping features. It is to be noted that elements of the first and second bodies and the shield case are introduced with reference numerals added with an apostrophe (') to distinguish them from the elements of the first and second bodies and the shield case of the first embodiment.

Figure 11:
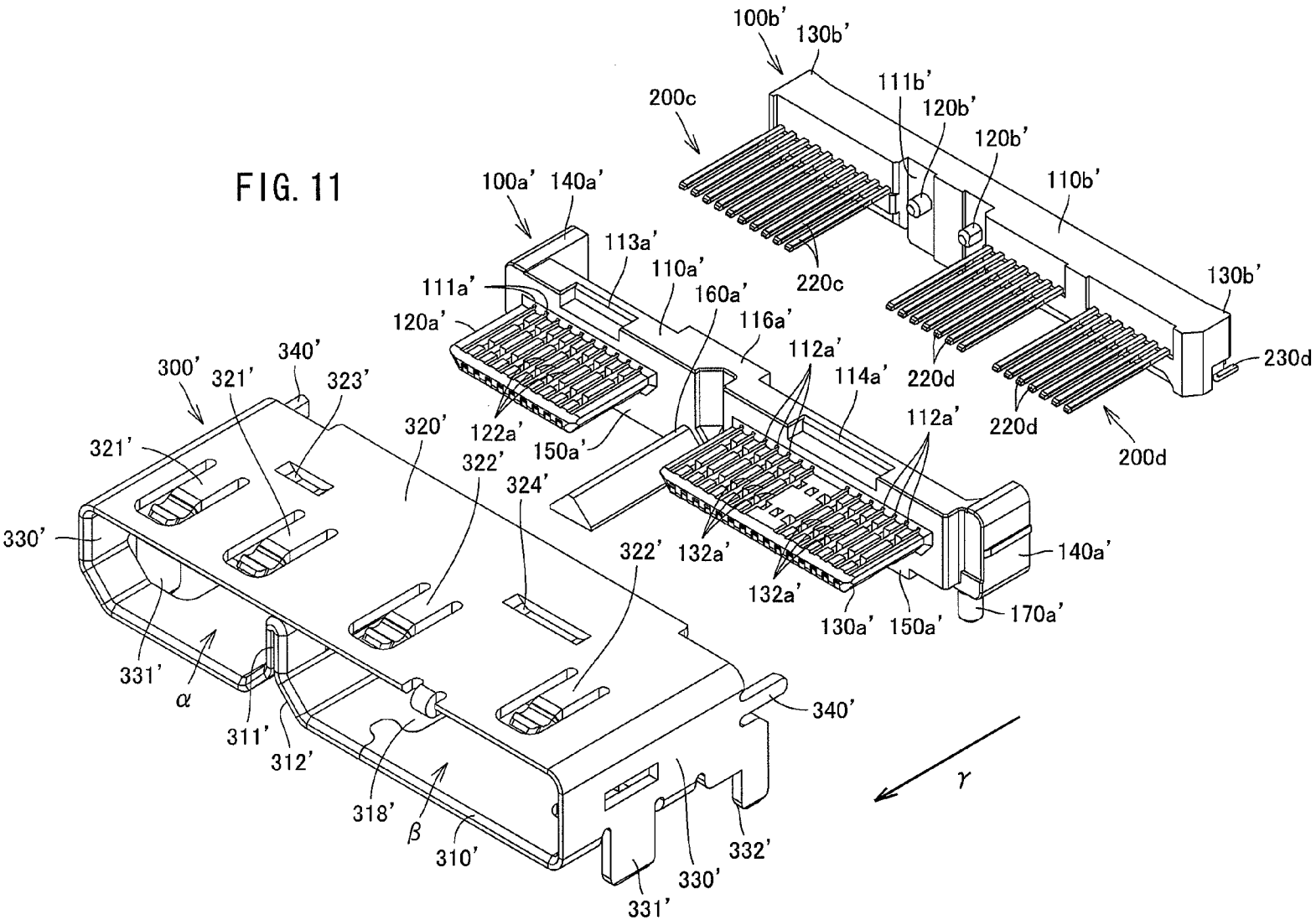
FIG. 11 is an exploded perspective view of the connector as seen from the front, plan and right side.
Figure 12:
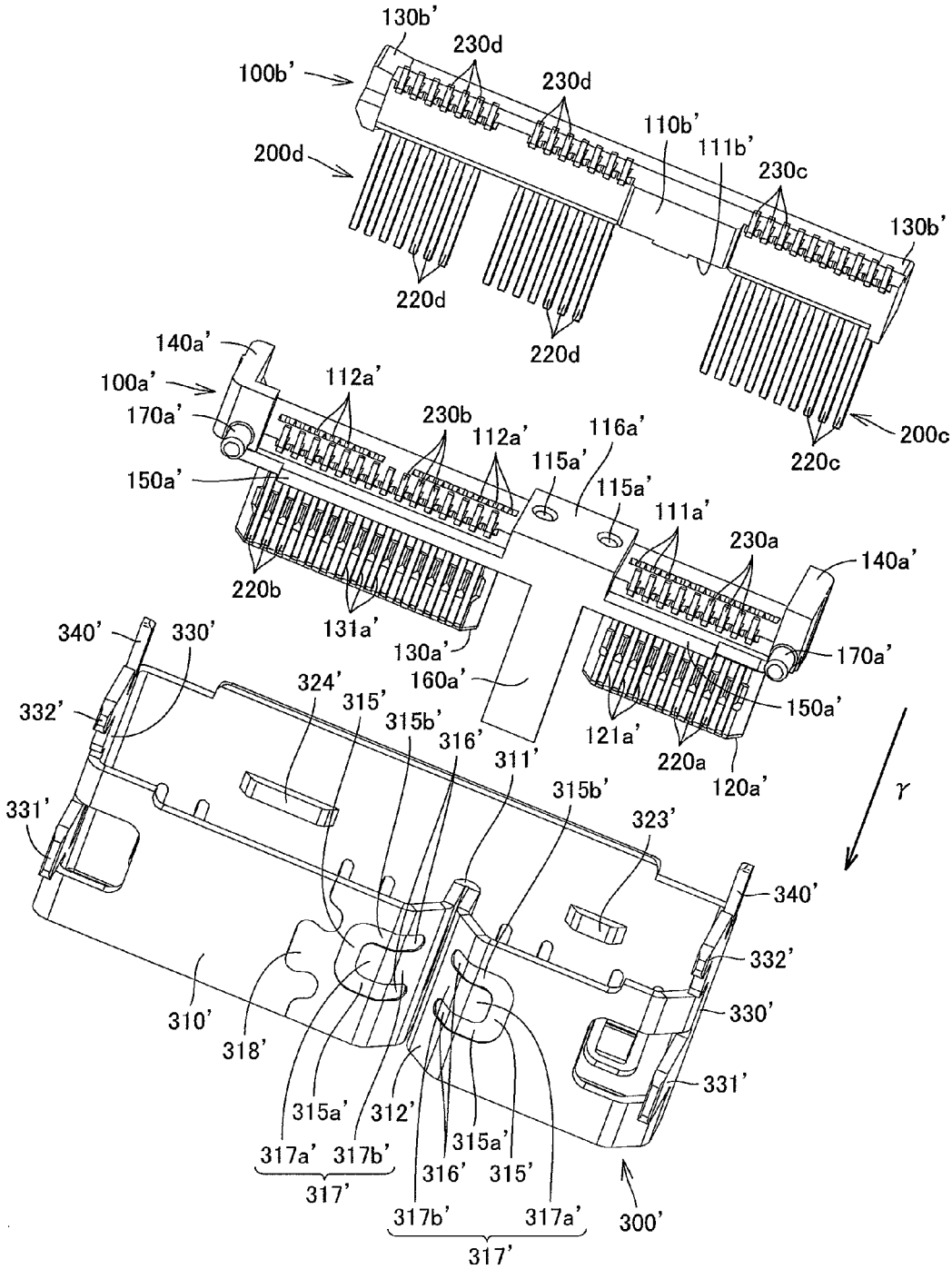
FIG. 12 is an exploded perspective view of the connector as seen from the back, bottom and left side.

The shield case 300' is different from the shield case 300 of the fust embodiment in shapes of a partition 311' and a depression 312' of a bottom plate 310'. Descriptions made hereinafter focus on the differences. As shown in FIGS. 8A to 12, the bottom plate 310' is bent at a central portion thereof into an inverted Y shape. The central portion (corresponding to "bent portion" recited in the claims) serves as the partition 311' having an inverted Y-shaped cross section, which partitions an internal space of the shield case 300' into the first and second slots α, β. The back side of the partition 311' forms the depression 312' (depressed surface of the partition) having a substantially triangular cross section. The partition 311' and the depression 312' extend the entire depth of the bottom plate 310, i.e. from the front end to the rear end in the insertion direction y of the bottom plate 310, as shown in FIG. 12. Both inner surfaces of the depression 312' are inclined with respect to an outer surface of the bottom plate 310'. In the boundary areas of the outer surface of the bottom plate 310' with the inner surfaces of the depression 312', there are formed generally U-shaped first recesses 315', each of which has first and second end portions 315*a*', 315*b*'. In each of the first recesses

315', the opening between the first and second end portions 315*a*, 315*b* faces inward, i.e. toward the depression 312'. In each of boundary areas of the inner surfaces of the depression 312' with the outer surface of the bottom plate 310', there is formed a pair of rectangular second recesses 316', communicating with the first and second end portions 315*a*', 315*b*' of the first recesses 315'. Areas defined by the first and second recesses 315', 316' serve as pads 317' for connection by soldering with the pair of ground electrodes 11 of the circuit board 10. The pads 317' each have first and second pad portions 317*a*', 317*b*'. The first pad portions 317*a*' are provided in the outer surface of the bottom plate 310'. The surfaces of the first pad portions 317*a*' are located at the same height as (i.e. flush with) the outer surface of the bottom plate 310'. The second pad portions 317*b*' are provided in the inner surfaces of the depression 312' and inclined with respect to the first pad portions 317*a*'. The surfaces of the second pad portions 317*b*' are located at the same height as (i.e. flush with) the inner surfaces of the depression 312'. FIGS. 8A to 12 also illustrate a joining portion 318', a top plate 320', side plates 330', lock pieces 340', locking pieces 321' and 322', abutting-stops 323' and 324', front terminals 331', and rear terminals 332'.

The first body 100*a*' is different from the first body 100*a* of the first embodiment in arrays of second holes 112' of a main body 110*a*' and fourth long grooves 132' of a second projected portion 130*a*', positions of fitting holes 115*a*' of the main body 110*a*', a newly provided fitting projection 116*a*' in the main body 110*a*', a shape of a reinforcing member 160*a*', and positions of a pair of locking projections 170*a*'. Descriptions made hereinafter focus on the differences. As shown in FIGS. 11 and 12, the main body 110*a*' has the second holes 112*a*' arrayed at spaced intervals with a wider interval in the middle of the array, and the second projected portion 130*a*' has the fourth long grooves 132*a*' at spaced intervals with a wider interval in the middle of the array. Accordingly, the same wider interval is provided in the middle of the row of the fourth contacts 200*d*, embedded portions 210*d* of which are embedded with the wider interval in the main body 110*b*' of the second body 100*b*'. The reinforcing member 160*a*' is a generally triangular prismatic arm projecting from a front surface of the main body 110*a*'. The length of the reinforcing member 160*a*' is the same as the length in the insertion direction γ of the depression 312', i.e., the reinforcing member 160*a*' fits in the entire depression 312'. The locking projections 170*a*' project from lower surfaces of a pair of guides 140*a*'. The locking projections 170*a*' are to be received and locked in the locking holes (not shown) of the circuit board 10. The fitting projection 116*a*' is a rectangular parallelepiped projection projected in the center of a rear end surface of the main body 110*a*'. The pair of fitting holes 115*a*' is formed in a rear surface of the fitting projection 116*a*'. FIGS. 9A to 12 also illustrate a first projected portion 120*a*', elongated protrusions 150*a*', first holes 111*a*', cutaways 113*a*' and 114*a*', first long grooves 121*a*', second long grooves 122*a*', and third long grooves 131*a'*.

The second body 100*b*' is different from the second body 100*b* of the first embodiment in a newly provided fitting depression 111*b*' formed in the center of a front surface in the insertion direction γ of the main body 110*b*', and positions of fitting projections 120*b*'. Descriptions made hereinafter focus on the differences. The fitting depressions 111*b*' are generally rectangular and adapted to fittingly receive the fitting projection 116*a*'. The pair of fitting projections 120*b*' is provided in the bottom of the fitting depression 111*b*'. The fitting projections 120*b*' are to fit in the fitting holes 115*a*' in the rear surface of the fitting projection 116*a*'. The main body 110*b*' and hills 130*b*' abut the lower surface of the top plate 320' of the shield case 300' as shown in FIGS. 10A to 10D.

The receptacle connector having the above-described configuration may be assembled in the following steps. First, as shown in FIGS. 11 and 12, the embedded portions 210*a*, 210*b* of the first and second contacts 200*a*, 200*b* are embedded in the first body 100*a*' by insert molding, and the embedded portions 210*c*, 210*d* of the third and fourth contacts 200*c*, 200*d* are embedded in the second body 100*b*' by insert molding. The embedded first and second contacts 200*a*, 200*b* are arrayed in a row in the width direction in the first body 100*a*', and the third and fourth contacts 200*c*, 200*d* are arrayed in a row in the width direction in the second body 100*b*'. Simultaneously, the contact portions 220*a*, 220*b* of the first and second contacts 200*a*, 200*b* are inserted into the first and second long grooves 121*a*', 131*a*' of the first body 100*a'*.

Thereafter, the first and second bodies 100*a*', 100*b*' are brought relatively closer to each other, and the contact portions 220*c*, 220*d* of the third and fourth contacts 200*c*, 200*d* of the second body 100*b*' are inserted into the first and second holes 111*a*', 112*a*' and the third and fourth long grooves 122*a*', 132*a*' of the first body 100*a*'. As a result, the contact portions 220*a* and the contact portions 220*c* are arranged at different height positions in a zigzag manner, and the contact portions 220*b* and the contact portions 220*d* are arranged at the different height positions in a zigzag manner. Simultaneously, the second body 100*b*' is inserted between the pair of guides 140*a*' of the first body 100*a*', using the guides 140*a*' of the first body 100*a*' to guide the widthwise ends of the second body 100*b*'. Consequently, the fitting projection 116*a*' of the first body 100*a*' fits in the fitting depression 111*b*' of the second body 100*b*' and the fitting projections 120*b*' of the second body 100*b*' fits in the fitting holes 115*a*' of the first body 100*a*'. Consequently, the first and second bodies 100*a*', 100*b*' are combined anteroposteriorly in the insertion direction γ, so that the tail portions 230*a*, 230*c* are arranged at the same height in two anteroposterior rows in the insertion direction γ, and the tail portions 230*b*, 230*d* are arranged at the same height in two anteroposterior rows in the insertion direction γ.

Thereafter, the reinforcing member 160*a*' of the first body 100*a*' is fittingly inserted into the depression 312' of the shield case 300'. During this insertion, the reinforcing member 160*a*' is guided by the depression 312' along the insertion direction γ. The first and second bodies 100*a*', 100*b*' are simultaneously inserted between the lock pieces 340' as straightened along the side plates 330'. Simultaneously, the first and second bodies 100*a*', 100*b*' are inserted along the insertion direction γ, from the rear side into the accommodating space of the shield case 300' while the widthwise ends of the first body 100*a*' are guided by the lock pieces 340', and the first and second projected portions 120*a*', 130*a*' of the first body 100*a*' are inserted into the first and second slots α, β of the shield case 300'. Consequently, the front surface of the main body 110*a*' of the first body 100*a*' abuts the partition 311'; the elongated protrusions 150*a*' of the first body 100*a*' abut the respective abutting-stop surfaces 313', 314' of the bottom plate 310' of the shield case 300'; and the abutting-stops 323', 324' of the top plate 320' of the shield case 300' are received from the front side in the cutaways 113*a*', 114*a*' of the first body 100*a*' and abut back surfaces of the cutaways 113*a*', 114*a*'. The guides 140*a*', the main body 110*b*' and the hills 130*b*' abut the top plate 320' of the shield case 300'.

In this state, the lock pieces 340' are bent inward to abut the hills 130*b*' of the second body 100*b*'. Consequently, the first and second bodies 100*a*', 100*b*' are securely sandwiched between the lock pieces 340' and front abutting portions (namely, the partition 311' and the abutting-stop surfaces 313', 314' of the bottom plate 310' and the abutting-stops 323', 324' of the top plate 320'), so that the first and second bodies 100*a*', 100*b*' are fixedly accommodated in the accommodating space of the shield case 300'.

The receptacle connector may be thus assembled and may be mounted on the circuit board 10 in a similar manner to the first embodiment. First, the front terminals 331' and the rear terminals 332' of the shield case 300' are inserted into the above-mentioned through-hole electrodes of the circuit board 10. Simultaneously, the locking projections 170*a*' of the first body 100*a*' are inserted into and locked against the locking holes of the circuit board 10. Consequently, the outer surface of the bottom plate 310' of the shield case 300' is placed on the circuit board 10, so that the pads 317' of the shield case 300' come into contact with the pair of ground electrodes 11 of the circuit board 10, and the tail portions 230*a*, 230*b*, 230*c*, 230*d* come into contact with the surface electrodes of the circuit board 10. Thereafter, the front terminals 331' and the rear terminals 332' are soldered to the through-hole electrodes of the circuit board 10, the pads 317' are soldered to the pair of ground electrodes 11, and the tail portions 230*a*, 230*b*, 230*c*, 230*d* are soldered to the surface electrodes of the circuit board 10. Solder fillets are thus formed between the second pad portions 317*b*' of the pads 317' and the ground electrodes 11.

In the above-described receptacle connector, the reinforcing member 160*a*' is fitted in the depression 312' on the back side of the partition 311' of the shield case 300'. If prying force is applied on the connector by the connection portion 31 of the plug connector 30 inserted into the slot a or by the connection portion 41 of the plug connector 40 inserted into the slot β, it is unlikely that the partition 311' and its surrounding area deform and that the joining portion 318' gets disjoined and released open. Further, the reinforcing member 160*a*' is adapted to fit in the whole of the depression 312' of the shield case 300', further improving the prying resistance of the connector compared to the connector of the first embodiment. Further, the reinforcing member 160*a*' projects from the front surface of the main body 110*a*' of the first body 100*a*, the reinforcing member 160*a*' can be fitted in the depression 312' of the shield case 300' when inserting the first and second bodies 100*a*', 100*b*' into the shield case 300'. This configuration can reduce assembling man-hours of the present connector. The connector also produces some other advantageous effects as in the receptacle connector of the first embodiment.

The above-described receptacle connector is not limited to the above-described embodiment, but it may be modified in design within the scope of claims. Examples of modifications are described more in detail below.

The shield case according to the first and second embodiments is a press-molded conductive metal plate, but the shield case may be modified in design as long as it is tuboid and has an internal space for accommodating a body. For example, the shield case may be formed of insulating resin or ceramic material in a tuboid shape, the outer surface of which may be deposited with metal. Alternatively, the shield case may be of conductive metal cast into a tuboid shape.

Figure 13:
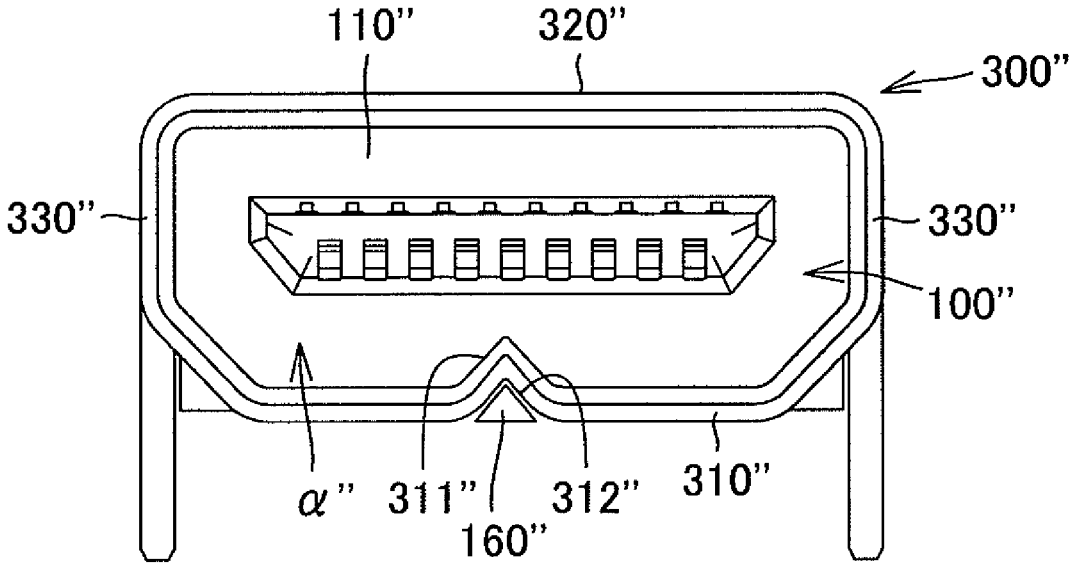
FIG. 13 is a schematic front view showing a modified connector according to the present invention.

In the first and second embodiments, the bent portion of the bottom plate is bent inside the shield case and extends through from the front end (first end) to the rear end (second end) in the insertion direction of the bottom plate of the shield case, and the bent portion functions as a partition to partition the internal space of the shield case into the first and second slots. However, the bent portion may be modified in design as long as it is formed by bending a part of the shield case inward and extends in the insertion direction of the body. For example, the bent portion may be provided in the top plate or one of the side plates. The bent portion may or may not extend through from the front end (first end) to the rear end (second end) in the insertion direction of the bottom plate, the top plate or one of the side plates of the shield case. Further alternatively, as in a connector as shown in FIG. 13, a bent portion of a bottom plate 310" of a shield case 300" may be used as a key portion 311" to fit in a key groove of a mating connector. Engagement of the key portion 311" in the key groove can prevent insertion of a nonconforming connector, such as ones with no key groove or with a different type of key groove. If the bent portion is used as the key portion 311", a reinforcing member 160" projecting from a front surface in the insertion direction of a main body 110" of a body 100" may fit in at least a part of a depression 312" on the back side of the key portion 311", so that the key portion 311" is reinforced, providing similar effects to those in the first and second embodiments. Further, the bent portion may not function as the partition or the key portion, but it may be provided for another role or just for an ornamental purpose. FIG. 13 also illustrates a top plate 320" and side plates 330".

Figure 14:
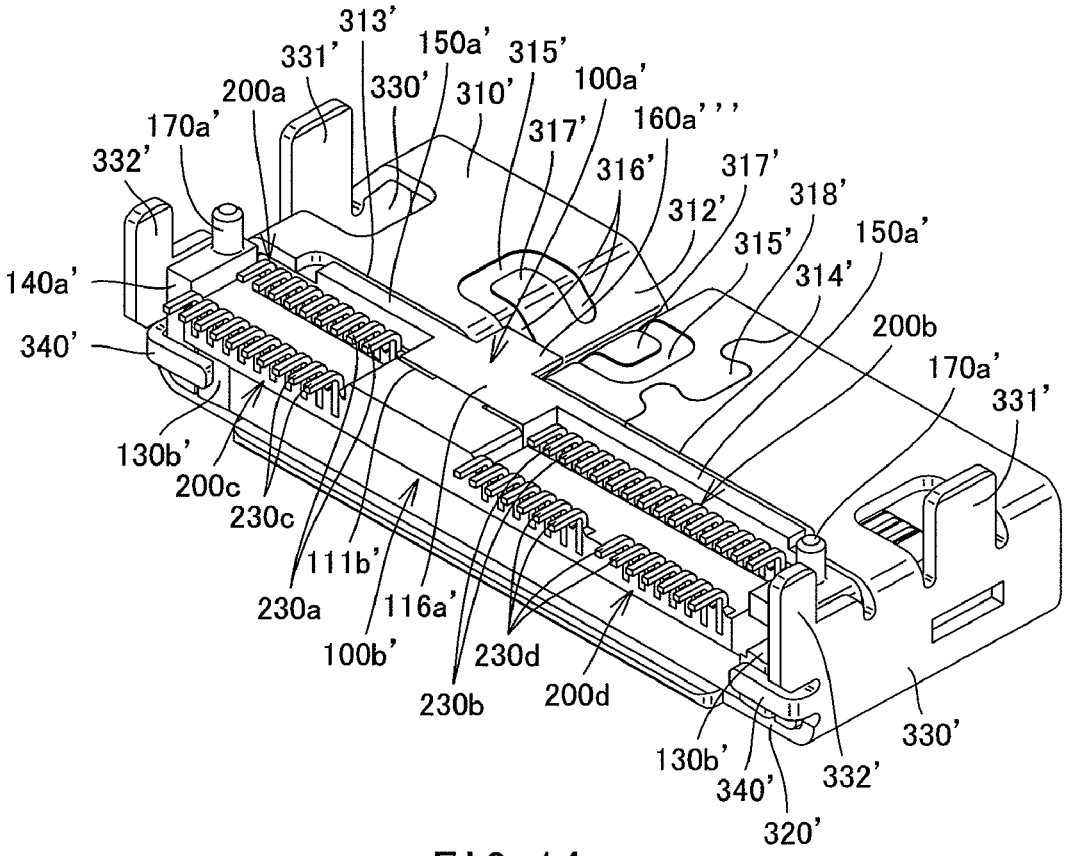
FIG. 14 is a schematic perspective view of a design modification of the connector according to the second embodiment as seen from the back, plan and right side.

The reinforcing member of the first embodiment fits in a part of the depression on the back side of the bent portion, and the reinforcing member of the second embodiment fits in the whole of the depression on the back side of the partition. However, the reinforcing member of the invention needs to fit in at least a part of the depression on the back side of the bent portion. For example, FIG. 14 illustrates a reinforcing member 160*a*'" of a smaller length in the insertion direction γ than the length in the insertion direction γ of the depression 312', so that the reinforcing member 160*a*'" fits in a part of the depression 312'. Moreover, the reinforcing member may or may not project from the front surface in the insertion direction of the first body. For example, a reinforcing member may be separately provided from the body to fit in the depression on the back side of the bent portion. Moreover, the reinforcing member may be made of harder material, e.g. metallic and ceramic materials, than that of the body. The reinforcing member may be attached to the body by press-fitting it into a bore opened in the body or by insert-molding it into the body.

The shield case of the first and second embodiments has the first and second slots, but may be modified as shown in FIG. 13, where a shield case 300" has only one slot α". Alternatively, the shield case may have three or more slots, by providing a plurality of bent portions, attaching separately formed partition plates to the inside of the shield case, or providing both the bent portion(s) and the partition plate(s). In the cases where the shield case has a plurality of slots, the internal space of the shield case may be partitioned with the partition plate, and the bent portion of the shield case may be used as the key portion or the like.

In the first and second embodiments, the first and second recesses defining the pads are provided in the boundary areas between the outer surface of the bottom plate and the inner surfaces of the lower depressed portion. However, the first and second recesses may be provided anywhere, as long as they are provided in boundary areas between two continuing surfaces of the shield case at an angle or at a right angle with respect to each other. For example, the outer surfaces of the side plates of the shield case may be arranged at an angle or at a right angle with respect to the outer surface of the bottom plate, and the first and second recesses may be provided in boundary areas between the outer surface of the bottom plate and the outer surfaces of the side plates. The second recesses are generally rectangular in the first and second embodiments, but they may be of any shape as long as they communicate with first and second end portions of the first recesses. For example, the second recesses may be curved such that their ends communicate with each other. The pads as described in the first and second embodiment are described by way of example only, and they may be modified in accordance with the shapes of the first and second recesses. The first and second recesses and the pads may be omitted when deemed unnecessary.

The present invention is not limited to the first and second embodiments where the shield case has the pair of front terminals and the pair of rear terminals. The front terminals and the rear terminals may be omitted, and only the front terminals or the rear terminals may be provided.

The connector in the first and second embodiments includes the first and second bodies, but the connector of the present invention requires at least one body. The connector of the invention requires at least one type of contacts. The contacts may not be embedded in the body but may be inserted into holes formed in the body. The tail portions of the contacts are arrayed in the two anteroposterior rows in the insertion direction in the first and second embodiments, but they may be arrayed in a row. Moreover, the tail portions may extend downward to be connected to the through-hole electrodes of the circuit board.

The materials, shapes, numbers, dimensions etc. of the respective elements of the receptacle connector in the first and second embodiments have been described by way of example only, and they may be modified in design in any manner as long as they provide similar functions. The present invention is not limited to the connectors described in the first and second embodiments where the first slot is compliant with the HDMI Type D standard and the second slot is compliant with a standard other than HDMI. The first and second slots may be modified in design in accordance with the mating connector so as to comply with any standard including other HDMI standards than Type D standard. For example, the first and second slots have the same internal shape so as to receive with mating connectors of the same type. Furthermore, the present invention is applicable not only to receptacle connectors but also to plug connectors with a cable connected to an end of a circuit board. Moreover, the television receiver is mentioned above as exemplifying the electronic equipment, but the present invention is not limited thereto.

Reference Signs List

10 circuit board
20 plug connector
30 plug connector
40 plug connector
100*a* first body
  160*a* reinforcing member
100*b* second body
200*a* first contact
200*b* second contact
200*c* third contact
200*d* fourth contact
300 shield case
  310 bottom plate
  311 partition (bent portion)
  312 depression (depressed surface of partition)
  318 joining portion

The invention claimed is:

1. A connector comprising:
a body having an insulating property;
a contact provided in the body;
a metallic tuboid shield case surrounding the body, the shield case including a bent portion, the bent portion being bent inward of the shield case to form a depression extending in an insertion direction in which the body is inserted into the shield case; and
a reinforcing member projecting from the body to fit in at least a part of the depression.

2. The connector according to claim 1, wherein in a cross section transverse to the insertion direction, the reinforcing member completely fills the depression.

3. The connector according to claim 1, wherein
the body includes a first surface in the insertion direction and a second surface on an opposite side of the first surface in the insertion direction, and
the reinforcing member projects from the first surface of the body.

4. The connector according to claim 2, wherein
the body includes a first surface in the insertion direction and a second surface on an opposite side of the first surface in the insertion direction, and
the reinforcing member projects from the first surface of the body.

5. The connector according to claim 1, wherein the bent portion partitions an internal space of the metallic tuboid shield case into first and second slots.

6. The connector according to claim 1, wherein the bent portion functions as a key portion that is insertable into a key groove of a mating connector.

7. The connector according to claim 5, wherein the metallic tuboid shield case is an electrically conductive plate bent into a tuboid shape, and the metallic tuboid shield case further includes a joining portion formed by joining end portions of the plate.

8. The connector according to claim 6, wherein the metallic tuboid shield case is an electrically conductive plate bent into a tuboid shape, and the shield metallic tuboid case further includes a joining portion formed by joining end portions of the plate.

9. Electronic equipment comprising the connector according to claim 1 as an external interface.

* * * * *